US007231879B2

(12) United States Patent
Gordon

(10) Patent No.: US 7,231,879 B2
(45) Date of Patent: Jun. 19, 2007

(54) COLLAPSIBLE PALLET SYSTEM AND METHODS

(76) Inventor: Norman H. Gordon, 1123 Tulip La., Munster, IN (US) 46321

( * ) Notice: Subject to any disclaimer, the term of this patent is extended or adjusted under 35 U.S.C. 154(b) by 0 days.

(21) Appl. No.: 11/216,608

(22) Filed: Aug. 31, 2005

(65) Prior Publication Data

US 2006/0016373 A1 Jan. 26, 2006

Related U.S. Application Data

(63) Continuation-in-part of application No. 11/118,904, filed on Apr. 29, 2005.

(60) Provisional application No. 60/566,256, filed on Apr. 29, 2004, provisional application No. 60/632,554, filed on Dec. 1, 2004, provisional application No. 60/652,871, filed on Feb. 15, 2005.

(51) Int. Cl.
*B65D 19/00* (2006.01)

(52) U.S. Cl. ..... 108/51.3

(58) Field of Classification Search ..... 108/51.3, 108/51.11, 56.3, 57.79
See application file for complete search history.

(56) References Cited

U.S. PATENT DOCUMENTS 2,444,183 A * 6/1948 Cahners ..... 108/51.3
2,643,080 A * 6/1953 Vogel ..... 108/51.3
2,904,297 A * 9/1959 Hamilton ..... 108/51.3
3,246,824 A * 4/1966 Gardner ..... 206/386
3,434,435 A * 3/1969 Achermann et al. ..... 108/51.3
3,626,860 A * 12/1971 Blatt ..... 108/51.3
4,863,024 A * 9/1989 Booth ..... 206/386
5,230,291 A * 7/1993 Juvik-Woods ..... 108/51.3
5,285,731 A * 2/1994 McIntyre ..... 108/51.3
5,503,085 A * 4/1996 Rozek ..... 108/51.3
5,921,187 A * 7/1999 Wang ..... 108/51.3
6,041,719 A * 3/2000 Vidal et al. ..... 108/51.3
6,564,724 B2 * 5/2003 Moberg ..... 108/51.3

FOREIGN PATENT DOCUMENTS

JP 06239345 A * 8/1994
JP 06239346 A * 8/1994

* cited by examiner

*Primary Examiner*—José V. Chen
(74) *Attorney, Agent, or Firm*—Valauskas & Pine LLC

(57) ABSTRACT

Formable pallets that are easy to construct into a generally stably product receiving state and easy to collapse into a storage/transport state. Embodiments of the pallet of which include a construction wherein one or more support beams can be further integrally formed from the sheet material of the pallet itself and function to support a product support surface on an uppermost surface of the pallet. The one or more support beams can be supported internally by structural inserts. Additionally, the supporting inserts may include braces for added stability and strength. The beams, as well as the platform can be further braced and structurally supported by cross braces, which run generally at right angles to the beams and pass through apertures in the beams themselves and slots in the inserts.

3 Claims, 6 Drawing Sheets

COLLAPSIBLE PALLET SYSTEM AND METHODS

This application is a continuation-in-part of U.S. patent application Ser. No. 11/118,904, filed Apr. 29, 2005; which claims the benefit of U.S. Provisional Application No. 60/566,256 filed Apr. 29, 2004; U.S. Provisional Application No. 60/632,554 filed Dec. 1, 2004; and U.S. Provisional Application No. 60/652,871 filed Feb. 15, 2005.

FIELD OF THE INVENTION

The present invention relates to a collapsible pallet and more specifically to a pallet formed from a sheet material.

BACKGROUND OF THE INVENTION

Pallets are platforms for supporting weight thereon, and by which materials, packages, or goods that are stacked thereon may be handled, stored and/or moved. Goods positioned on pallets are typically moved and stored in warehouses, factories, or vehicles, for example, by forklift equipment, in which the forklift tines are inserted into channels in the pallet or by way of engagement with an undersurface of a top deck of the pallet.

Pallets have traditionally been formed from wood, plastic and various composite materials. Wood pallets, however, are subject to breakage and difficult to obtain and maintain in a sanitary condition. In environments where sanitation is important, such as in the food industry, pallets may be of limited usefulness. From time to time, the wood used in pallets is also known to contain eggs or actual insects thereby causing problematic infestations. Plastic pallets are bulky and initially, may be very expensive. Wood or plastic pallets are typically provided in a fully erected or constructed state and not deconstructed when not in use and therefore always require a maximum amount of space.

While a number of attempts have been made to design inexpensive, but structural dependable pallets, there continues to be a need for improvements in both cost, ease of use, and overall strength. The present invention satisfies this need.

SUMMARY OF THE INVENTION

The present invention is directed to a pallet that is easily assembled by a single person without tools and from easily transported and manipulated components. The components can be varied to easily provide pallets of different size and structural dependability. Each of the components for and the assembled pallet is lightweight and uses fewer materials than many pallets made from similar materials. This further reduces waste, lowers shipping costs and ultimately fuel consumption costs associated with the transport of the product shipped on the pallets on the issue of fuel consumption. It has been estimated by the Ford Motor and Automotive Aluminum Association that for every 10 percent reduction in vehicle weight there is a corresponding 6 to 8 percent savings decrease in fuel usage. Comparing an embodiment of the pallet of the present invention to a standard 48×40 inch wood pallet, a savings in fuel usage to carry up to 1200 pounds per truck load (i.e., 30 pounds per pallet savings multiplied by 40 pallets per truck) would result. Less weight means decreased fuel usage and therefore fewer atmospheric emissions. Also, since weight is a factor in road and highway damage, the less weight per truck means less road damage and fewer traffic jams due to highway construction.

The modular pallet of the present invention is formed from one or more components that can be shipped and stored in a largely flattened state. As a result, prior to assembly, a pallet according to the present invention can take up little space, thereby reducing transportation and storage costs. After formation or assembly, for example, the pallet may be racked into the size permitted by the components, such as a space occupying 4½"×48"×42".

The materials from which the pallet components may be made can be "environmentally friendly," and therefore present low environmental impact. The pallet of the present invention and its components may be formed or joined without the use of metal staples, nails, or other fasteners. The staples, nails or other fasteners used in constructing conventional pallets are typically environmentally "less friendly". They also may cause harm, such as to a user, when dislodged from the pallet. The use of materials other than wood for the collapsible pallet of the present invention is also economically and environmentally friendly. For example, the use of material other than wood for one or more components of the pallet of the present invention mostly eliminates the need to fumigate the pallet in order to destroy those destructive elements, such as the longhorn beetle that can typically harbor in the wood. In addition, the collapsible pallet of the present invention can be re-used multiple times. Due to the materials used in preferred embodiments of the invention, namely cardboard and like paper-based materials, repairs can be easily made and the present invention contemplates the use of what are termed "repair kits" with the pallets.

The materials from which the components of the pallet may be made may be of a composition, or treated with other materials so that the components and the assembled pallet is generally insect or germ free and water resistant thereby permitting the pallet to be used in a moist or wet environment without perceptible loss in structural dependability. Other embodiments may include components and be structured so that the pallets are fire resistant, heat resistant, anti-static, or respond to additional user transport and storage specifications.

The pallet of the present invention includes tubing elements, either singular or multi positional, for the construction of a generally stable platform, either in a permanent or semi-permanent way. The tubing may be sized and shaped to hold a variety of materials on the inside or outside thereof, yet not restrict the ability of the pallet to be assembled or disassembled in a "knock-down" fashion and provide a variety of options for reinforcing the strength and stability of the pallet by adding or subtracting material structure and material strength depending on the load placed on the platform. Heavier loads may require higher yield material while lighter loads may be constructed of lesser yield materials.

Additional advantageous features of the pallet of the present invention are many. The pallet may include informational surfaces that may be used, if desired, for informational purposes such as by being decorated by processes of printing, laminating, stamping, spraying, etc. and can offer benefits such as bar coding, assembly instructions, and advertising. The platform may carry radio frequency friendly identification devices by which information concerning, for example, ownership and use and location of the platform may be provided. Various parts, sections or components of the pallet may be color coded, for example, for decorative purposes or for informational purposes such as to identify the carrying capacity or special use purpose of the pallet, to identify the owner of the material carried on the pallet, the owner of the pallet, promotional or advertising purposes, or simply to facilitate the construction or deconstruction of the pallet.

Additionally, the material used, in the making of the platform, may also be constructed in such a way that it offers cushioning to help absorb shock vibrations. The platform user may be able to choose if they wish the platform delivered to them in an assembled state for immediate use or in a disassembled state for each pallet assembly. Because the components of the platform are sized and shaped to fit in a reduced amount of space (relative to the fully assembled pallet) in a disassembled state, shipping and storage costs are reduced. The platform may be made so that it can be erected by hand, hand and machine or machine only. This offers a number of options in the assembly process. The platform, if need be, can be constructed in such ways that it can be moved on conveyors or accept wheels, castors, or another roller type product for movement, or racking systems for storage or display. Multiple points of entry can be provided in pallets of the present invention so that, for example, a fork lift truck or hand jack or other mechanical assistance can be used to lift and move the pallet. Components of the pallet can be formed through materials that facilitate reuse or recycling of the components or the material from which the components are made. The platform can be constructed so that additional elements, such as add-on parts, can be added to give the platform added benefits such as display advertising, void filling, and convention type presentation. The platform itself may be saved and recycled to use as a cost saving feature in other inventions.

A further object of the present invention is to provide a pallet some embodiments of which include decorative or esthetic elements such that the pallet may be used in more public venues and not simply the warehouse. Conventional pallets, to the extent they are constructed of cardboard, have corrugated flutes. Embodiments of the present invention eliminate what may be viewed as aesthetically unappealing exposure of corrugated flutes by providing various assembly constructions such that the cross sections of the corrugated cardboard are hidden or secluded from all outside or exposed surfaces. Moreover, it is contemplated the present invention may be assembled of cardboard constructed without corrugated flutes. The singularity of sheet through a printing press means the sheet can be printed and die cut at the same time thereby saving money on many decorative operations.

A further object is to provide a tracking functionality to one or more pallet embodiments, for example, through the single or coordinated use of bar codes, hologram, or RFID tags (tracking devices). A bar code is a series of lines of that can be read by a computer input device, for example, a bar code scanner and provide a wide variety of information. A hologram is a three-dimensional photograph or illustration, created with an optical process that uses lasers. Holograms are difficult to replicate or counterfeit. A RFID tag, or radio frequency identification tag, is a type of electronic identification that uses radio frequency signals to read information. A tracking device may be applied to each component, larger groupings of components, or the fully assembled pallet. The tracking device can communicate a variety of information, for example, certification of the maximum weight the pallet is capable of supporting, origin, and destination of the product associated with a particular pallet along with the location at any given moment in time. It is further contemplated that the tracking device may include other sorts of information such as a customer's logo. The components of the pallet may additionally have designations by which the pallet components may be identified, located, and tracked. Components suitable for reuse may include designations or identifications that assist one or more subsequent purchasers of the use history of that component. A corporate certification stamp such as one backed by insurance, that, for example, is used in the corrugated box industry, can be used to designate manufacturing guarantees such as product transport or storage warranties. One or more components of the pallet may be certified, such as in printed information including the manufacturer's or shipper's information, identification or logo to make sure that only that business' product is shipped or used with the identified pallet. This is important when quality control certification only applies when the business' given product is carried on the identified pallet. Other features will become apparent in the following description.

While the prior art describes many variations on cardboard type pallets and related products, no apparatus system or method is described wherein a pallet is formed with support beams that are integrally formed from the sheet material base. Embodiments of the present invention can include supporting inserts in the beams as well as cross-braces or slats located against the underside of the base platform itself. The beams as well as the platform are structurally supported by cross-braces, which run at right angles to the beams. They can be angled, positioned, or arranged in different formats depending on the need.

In other words, embodiments of the pallet of the present invention include beams, which are supported internally by structural inserts that may be of varying size and shape. Moreover, the inserts may further include braces that are positioned within the structural inserts to provide additional support. The braces may be of any suitable material, size, and shape to fit within the structural insert.

Embodiments may include cross-braces that pass through an aperture in the beams themselves. The cross-braces may be positioned such that they do not interfere with the structural inserts or braces. Moreover, the structural inserts and braces themselves may include slots through which the cross-braces may pass. The cross-braces may pass underneath and support the underside of the platform to create significant structural support.

A further object of the present invention is to provide embodiments having a supporting structure, or stabilizer, under the pallet to adequately distribute the load carried on the platform panel of the pallet. The stabilizer can be of any shape or size and constructed from various materials including, wood, plastic, cardboard, fiberboard, rigid foam, fiberglass, carbon-fiber, composite materials and so on, capable of providing support to the platform panel of the pallet.

Multiple pallets may be joined, such as through a variety of simplified embodiments of the pallet including those having interconnecting male and female components that permit the engagement of the male protrusion into a female receptacle, each of which is positioned within the support beams. The male protrusion and female receptacle can be broken down flat along with the entirety of the pallet for ease of shipping and storage described above.

The present invention, in one aspect, is a pallet fabricated of a sheet of material for receiving product, including a platform including a first platform side and a second platform side, the first platform side being opposite the second platform side. In one embodiment, the pallet may include a beam that is sized, shaped and positioned to assist in the support of a load on the generally horizontal product support surface of the pallet, In another embodiment, the pallet may include a plurality of support beams to assist in the support of loads on the product support surface of the pallet. For example, one such embodiment that may include a first beam located along the first platform side on an underside of the platform and a second beam located along the second platform side on the underside of the platform to assist in the support of a load on the support surface of the pallet.

Embodiments of the pallet may include one or more support beams sized and shaped and constructed to accommodate the receipt of an insert. For example, an insert may be positioned in one or more of the support beams, each of the inserts being constructed and formed of a material capable of assisting in the support of at least the weight of the product carried on the product support surface thereon.

Another aspect of the invention provides a pallet for receiving product thereupon, including a platform including a first platform side and a second platform side, the first platform side being opposite the second platform side. A first beam is located along the first platform side on an underside of the platform and a second beam is located along the second platform side on the underside of the platform. A third beam is positioned between the first beam and the second beam and an insert is positioned in each of the first beam, second beam and third beam, each insert being constructed and formed of a material capable of withstanding at least the weight of the product bearing thereupon.

Yet another aspect of the invention provides a pallet for receiving product, including a platform with a first platform side and a second platform side, the first platform side being opposite the second platform side. A first beam is positioned along the first platform side on an underside of the platform. A second beam is positioned along the second platform side on the underside of the platform. A third beam is positioned between the first beam and the second beam. Each of the first beam, the second beam and the third beam may include a plurality of cross-brace beam openings formed therethrough. Accordingly, a plurality of cross-braces may be positioned in the cross-brace beam openings to extend from the first platform side to the second platform side and adjacent the underside of the platform to support the platform. An insert is positioned in each of the first beam, second beam and third beam, each insert being constructed and formed of a material capable of withstanding at least weight of the product bearing thereupon.

Yet another aspect of the invention provides a pallet for receiving product, including a platform with a first platform side and a second platform side, the first platform side being opposite the second platform side. A first beam is positioned along the first platform side on an underside of the platform. A second beam positioned along the second platform side on the underside of the platform. A support structure is positioned between the first beam and the second beam, wherein each of the beams includes a plurality of cross-brace beam openings formed therethrough. Cross-braces are positioned in the cross-brace beam openings to extend from the first platform side to the second platform side and adjacent the underside of the platform to support the platform. Inserts in each of the first beam, second beam and third beam, are constructed and formed of a material capable of withstanding at least weight of the product bearing thereupon.

Yet another embodiment of the invention provides a pallet for receiving product, including a platform with a first platform side and a second platform side, the first platform side being opposite the second platform side. A first beam is positioned along the first platform side on an underside of the platform. A second beam is positioned along the second platform side on the underside of the platform. Each of the first beam and the second beam includes a plurality of cross-brace beam openings formed therethrough. Cross-braces are positioned in the cross-brace beam openings to extend from the first platform side to the second platform side and adjacent the underside of the platform to support the platform and an insert is positioned in each of the first beam, second beam and third beam. Each insert is constructed and formed of a material capable of withstanding at least weight of the product bearing thereupon.

Yet another embodiment of the invention provides a pallet system for receiving product, including a pallet with a platform including a first platform side and a second platform side, the first platform side being opposite the second platform side. A first beam is located along the first platform side on an underside of the platform. A second beam is located along the second platform side on the underside of the platform. An insert is positioned in each of the first beam and second beam. Each insert is constructed and formed of a material capable of withstanding at least weight of the product bearing thereupon. A hollow, rectangular sleeve is sized and shaped to fit over the pallet.

Yet another embodiment of the invention provides a system for supporting, transporting and/or storing product, including a first pallet with a first pallet platform including a first platform side and a second platform side, the first platform side being opposite the second platform side. A first beam is located along the first platform side on an underside of the platform. A second beam is located along the second platform side on the underside of the platform, wherein the second beam includes one or more male protrusions. A second pallet is provided with a second pallet platform including a third platform side and a fourth platform side, the third platform side being opposite the fourth platform side. A third beam is located along the third platform side on an underside of the second pallet platform. A fourth beam is located along the fourth platform side on the underside of the second pallet platform, wherein the fourth beam includes one or more female receptacles sized and shaped to receive the one or more male protrusions to form a combined pallet system from the first pallet and the second pallet. An insert is provided in each of respective the first beam, the second beam, the third beam and the fourth beam, each insert being constructed and formed of a material capable of withstanding at least weight of the product bearing thereupon.

Yet another embodiment of the invention provides a system for supporting, transporting and/or storing product, including a pallet with a platform including a first platform side and a second platform side, the first platform side being opposite the second platform side. A first beam is located along the first platform side on an underside of the platform. A second beam is located along the second platform side on the underside of the platform. An insert is positioned in each of the first beam and second beam, each the insert being constructed and formed of a material capable of withstanding at least weight of the product bearing thereupon and a display element including display information is positioned on the pallet and wherein the display covers some or the entire pallet.

Another aspect of the invention provides a method of forming a pallet, including providing a sheet of material, positioning one or more cross-braces on an underside of the sheet of material, positioning two or more spaced inserts on the underside of the sheet of material and over the one or more cross-braces, and assembling a beam over each of the two or more spaced inserts, whereby both the one or more cross-braces and the two or more spaced inserts are locked in place with each of the two or more spaced inserts being located within a respective beam.

Yet another aspect of the invention provides a lightweight, foldable cost-saving pallet system for shipping product, including a pallet with a single sheet of foldable material including a central platform with a first platform side and a second platform side, the first platform side being opposite the second platform side. A first beam is located along the first platform side on an underside of the central platform. The first beam is shaped to expand from a first configuration to a second configuration, wherein the first configuration is rhomboid or a flattened rectangle in cross section and the second configuration is in the form of a hollow rectangle in cross section. A second beam is located along the second platform side on the underside of the central platform, wherein the second beam has the same shape as the first beam. An insert is sized and shaped to fit within each of the first beam and the second beam when the first beam and the beam are in the second configuration, each insert being constructed and formed of a material capable of withstanding at least weight of the product bearing thereupon.

Yet another aspect of the invention provides a system for supporting product with a tracking feature, including a pallet for supporting product thereupon, including a platform including a first platform side and a second platform side, the first platform side being opposite the second platform side. A first beam is located along the first platform side on an underside of the platform. A second beam is located along the second platform side on the underside of the platform. An insert is positioned in each of the first beam and second beam, each insert being constructed and formed of a material capable of withstanding at least weight of the product bearing thereupon and a tracking device for tracking one or both of the pallet and product positioned upon the pallet. The tracking device may be a RFID or the like encapsulated in the pallet material or inside a separate compartment of the pallet.

The present invention and its attributes and advantages further understood, will be further appreciated with reference to the detailed description below of some presently contemplated embodiments, taken in conjunction with the accompanying drawings.

BRIEF DESCRIPTION OF THE DRAWINGS

The preferred embodiments of the invention will be described in conjunction with the appended drawings provided to illustrate and not to the limit the invention, where like designations denoted like elements, and in which.

DETAILED DESCRIPTION OF THE PREFERRED EMBODIMENTS

This application incorporates by reference the entire subject matter of U.S. patent application Ser. No. 11/118,904, filed Apr. 29, 2005.

The present invention will now be described in detail with reference to preferred embodiments as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures are not described in detail in order to not unnecessarily obscure the present invention. For convenience of description, terms such as "upper", "lower", "top", "bottom", "above", "underneath", "outer", "inner", "horizontal", "vertical" "outwardly", and "inwardly" are used to refer to the orientation illustrated in the accompanying drawings. However, it will be understood that embodiments advantageously can be used in a variety of orientations.

Figure 1:
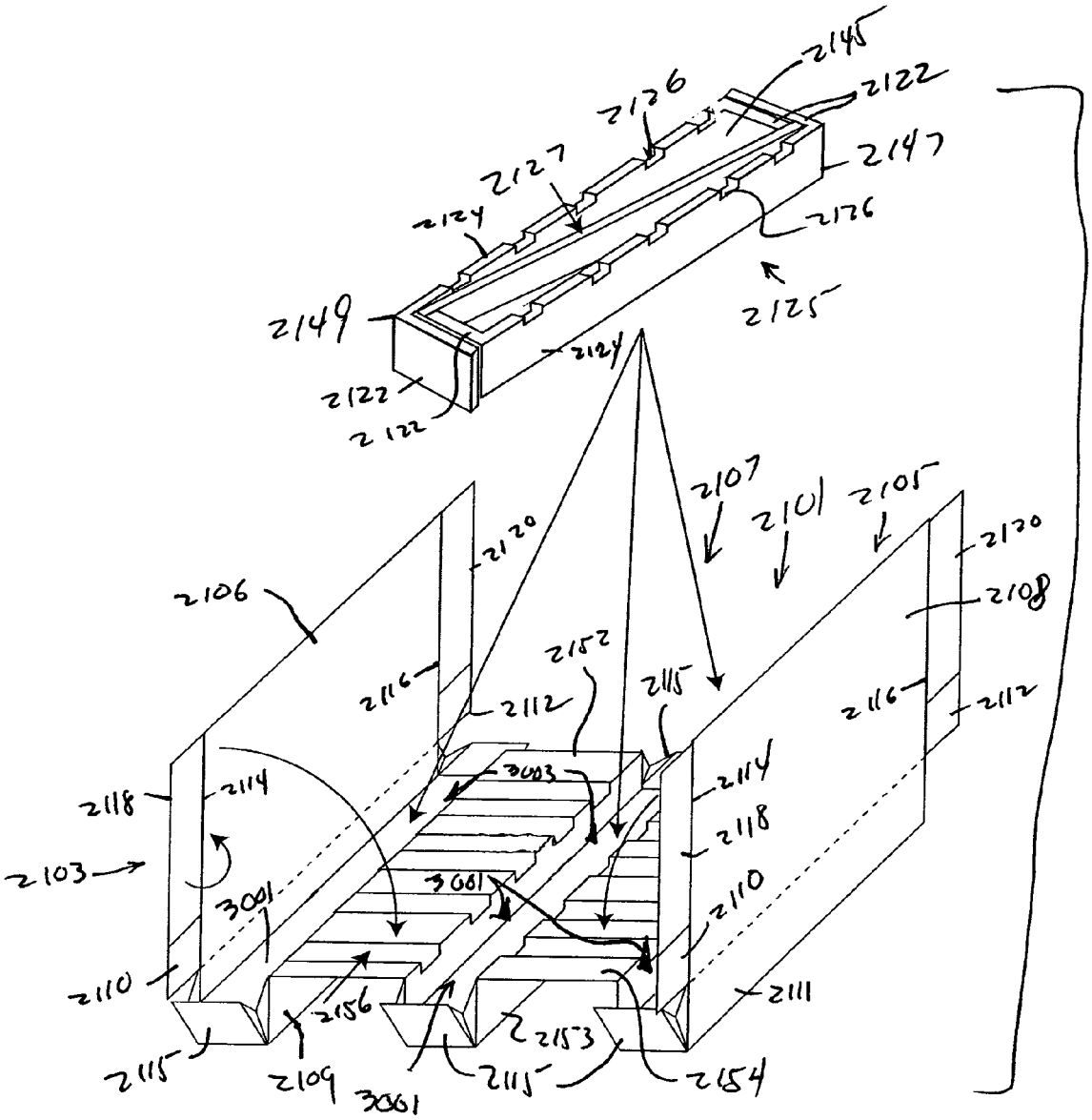
FIG. 1 shows a perspective view of one embodiment of a pallet according to the present invention and a perspective view of an embodiment of an insert according to the present invention.

FIG. 1 shows one embodiment of a pallet and an insert, according to embodiments of the present invention, and illustrated generally by reference to numbers 2101 and 2125, respectively. Generally, the illustrated embodiment of the pallet 2101 may be of a unique construction and can be formed from a generally continuous, single material sheet 2103 sized and shaped and constructed so that a supporting platform generally shown at 2105 may be formable therefrom. While the sheet 2103 may be formed from a paper-based, non-paper based or composite material, one preferred material from which the sheet 2103 may be made is corrugated paperboard or cardboard. Other suitable materials include a single type of plastic or combinations of types of plastic or plastic/paper combinations of material, or other composite materials. Also, other suitable materials include wood, fiberglass, laminated materials, metal, or extruded recycled materials, for example. The present invention may relate to a pallet, which may be assembled at any time or a pre-assembled pallet and more specifically assembled from a sheet-like material. A key feature of the present invention includes the ability to provide one or more pallets 2101 in a flat, pre-assembled condition, which when needed, is easily erected into a supporting state for use as will be explained more fully hereinafter.

Furthermore, the insert 2125 may be considered optional, depending at least in part on the material used to construct the pallet 2101, and also on the intended use of the pallet. For example, if the pallet 2101 is made of a metal material, the insert 2125 may not be needed for structural reinforcement. In addition, if the pallet 2101 is used to support very lightweight materials, the inserts 2125 may not be needed for structural reinforcement.

The platform 2105 of the embodiment shown in FIG. 1, includes a left panel 2106 and a right panel 2108 defined by portions of the sheet 2103, which forms a product receiving surface 2107 when left panel 2106 and right panel 2108 are in a horizontal position. In other embodiments of the presently illustrated invention and those that follow, it will be understood that the panels 2106, 2108 are optional and a product receiving surface 2107 (or the like) will be constituted by the uppermost, generally horizontal surface presented by the constructed pallet capable of receiving product thereon.

Each of the left panel 2106 and the right panel 2108 include a front end tab 2110 and a rear end tab 2112 attached respectively to front and rear edges (2114, 2116) of the left panel 2106 and the right panel 2108. Similarly, each of the left panel 2106 and the right panel 2108 include a front under tab 2118 and a rear under tab 2120 attached respectively to front and rear edges (2114, 2116) of the left panel 2106 and the right panel 2108.

The pallet 2101 includes left, right and middle beams 2109, 2111 and 2153. Each of beams 2109, 2111, and 2153 of the illustrated embodiment includes an interior surface 3001 that may define, for example, a generally rectangular interior space 3003 sized and shaped to receive a correspondingly sized and shaped insert 2125. As will be shown below in more detail, the number of beams may be one or more beams.

The insert 2125 may be of other sizes and shapes. In one preferred embodiment, the shape of each insert 2125 defines an interior space 2145 such as one as one sized and shaped to receive a brace 2127 therein. Each of the illustrated embodiments of the insert 2125 includes a first insert member 2147 and a second insert member 2149. Each insert member 2147, 2149 includes two short sides 2122 at opposite ends thereof and a long side 2124 disposed between the short sides. The insert members 2147, 2149 are arranged to form a rectangle with the interior space 2145 defined within for receiving the brace 2127.

The brace 2127 is preferably rigid and may be made of any supportive material, such as, for example, wood, metal, or a composite material capable of supporting a load placed on the pallet 2101. The long sides 2124 of the insert members 2147, 2149 include a dentate upper surface 2126 for receiving one or more cross member (not shown) for supporting the platform 2105.

The platform 2105, which forms a product receiving surface 2107 when panels 2106, 2108 are in a horizontal configuration overlie left and right sections 2152, 2154, which are situated between and provide a span between left and middle beams 2109, 2153, and middle and right beams 2153, 2111, respectively. Each of the left and right pallet sections 2152, 2154 include a plurality of spaced slots 2156, which are positioned to cooperate with the dentate upper surface 2126 of inserts 2125, so as to house cross braces (see FIG. 2) disposed therein. Each of beams 2109, 2153, 2111 include a pair of front and rear folding end tabs 2115 for closing each of the beams.

Figure 2:
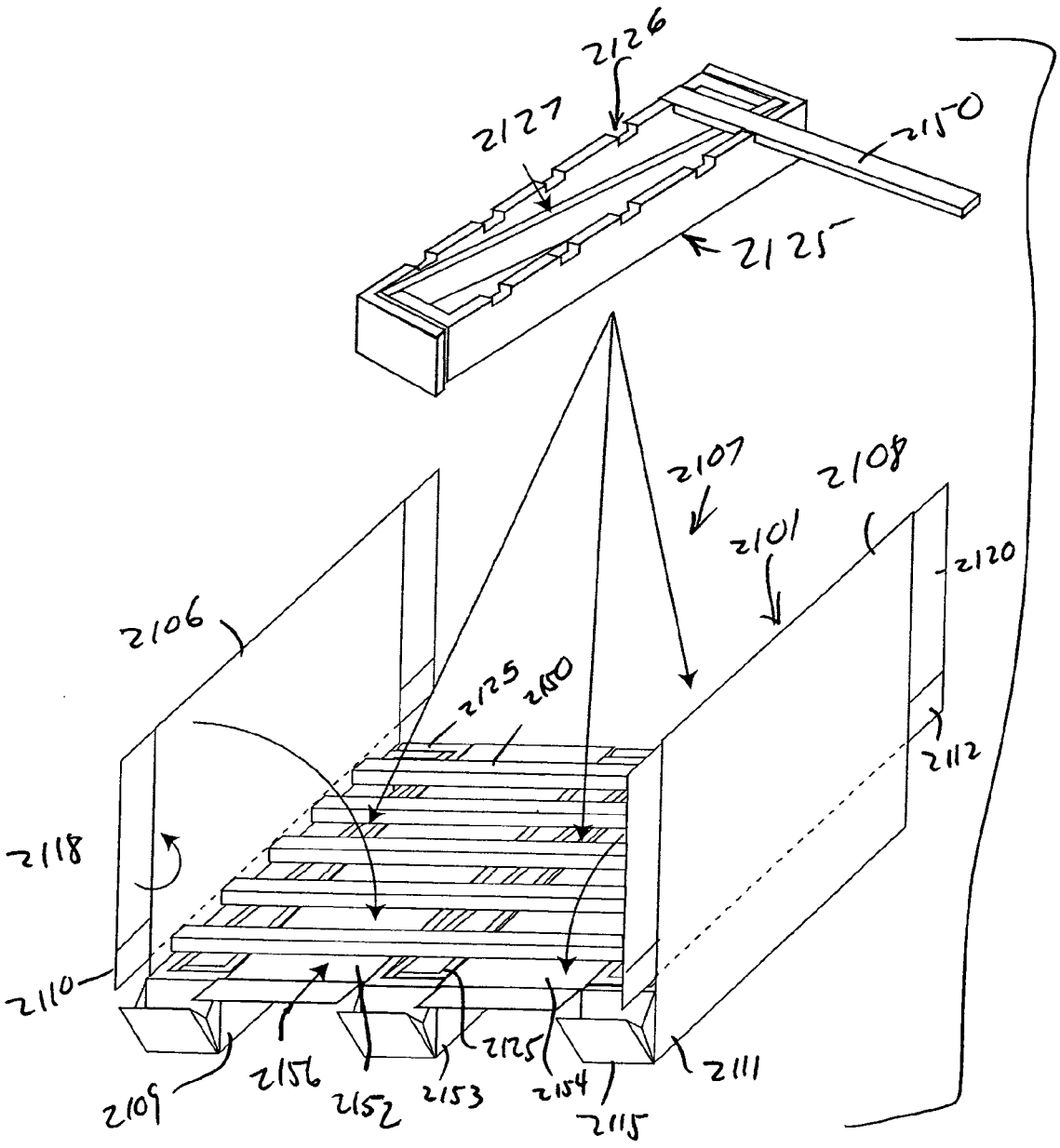
FIG. 2 shows a perspective view of the pallet of FIG. 1 and a perspective view of an embodiment of an insert, with cross braces in place.

Turning to FIG. 2, when the pallet 2101 is constructed an insert 2125 may be positioned within one or more than one of the beams 2109, 2153, 2111. The front and rear folding end tabs 2115 are urged into a closed position. Various other methods can be used to seal the insert within the beam, for example with a separate end cap (not shown).

Cross braces 2150 are positionable into position in the dentations 2126 and slots 2156. The left panel 2106 and a right panel 2108 are constructed so that each may be lowered onto the cross braces and sections 2152, 2154. The front end tabs 2110 and rear end tabs 2112 are affixed to the tabs 2115 by any suitable means, for example, an adhesive. The front under tab 2118 and a rear under tab 2120 are folded under the sections 2152, 2154 to retain the left panel 2106 and the right panel 2108 in a horizontal position effectively completing the construction of the pallet 2101.

Figure 3:
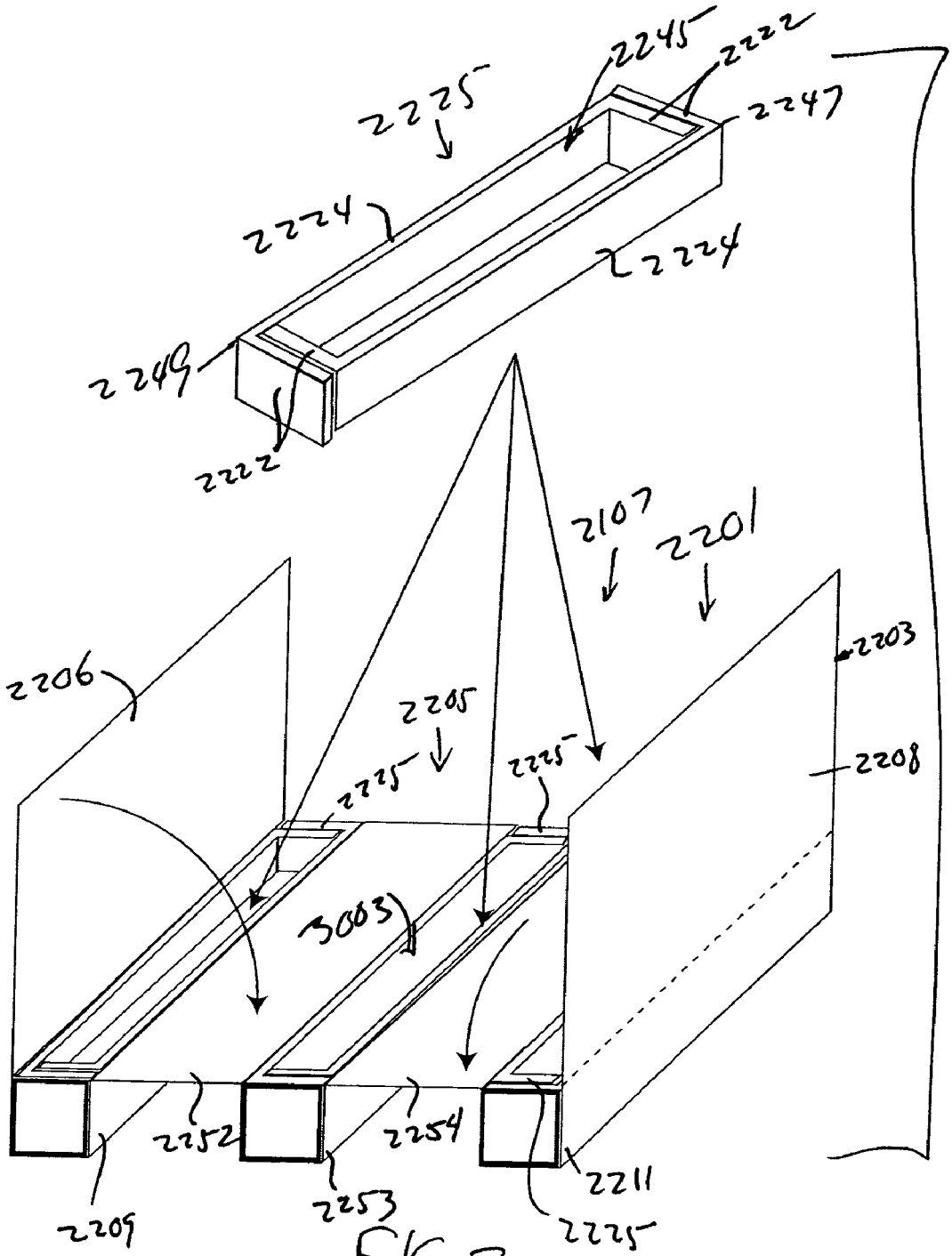
FIG. 3 shows another embodiment of a pallet and insert according to the present invention.

FIG. 3 shows a pallet 2201 and an insert 2225 according to another embodiment of the invention. Generally, the illustrated embodiment of the pallet 2201 is of a unique construction including a continuous, single material sheet 2203 forming a supporting platform generally shown at 2205. Preferably, the material from which the sheet 2203 is made is corrugated paperboard or cardboard as above.

The present invention may relate to a pallet 2201, which may be assembled at any time or a pre-assembled pallet and more specifically assembled from a single sheet of material. A key feature of the present invention includes the ability to provide one or more pallets 2201 in a flat, pre-assembled condition, which when needed, is easily erected into a supporting state for use as will be explained more fully hereinafter.

The platform 2205 illustrated in FIG. 2 includes a left panel 2206 and a right panel 2208 defined by portions of the sheet 2203. The left panel 2206 and right panel 2208 form rectangular portions of the platform 2205 and when in a horizontal position can form product receiving surface 2107 thereby.

The pallet 2201 includes left, right and middle beams 2209, 2211 and 2253. Each of the beams 2209, 2211, and 2253 define a roughly rectangular interior space 3003 sized and shaped to receive a respective insert 2225.

The insert 2225 includes an interior space 2245 defined by a first insert member 2247 and a second insert member 2249. Each insert member 2247, 2249 includes two short sides 2222 at opposite ends thereof and a long side 2224 disposed between the short sides. The insert members 2247, 2249 are arranged to form a rectangle with the interior space 2245 defined within.

The platform 2205, on which a product receiving surface 2107 is formable when panels 2206, 2208 are in a horizontal configuration overlie left and right sections 2252, 2254, which are situated between and provide a span between left and middle beams 2209, 2253, and middle and right beams 2253, 2211, respectively. Each of the left and right pallet sections 2252, 2254 are flat planar sections. The embodiment of the pallet and insert 2201, 2125 shown in FIG. 3 is constructed similar to that shown above with the exception of lacking cross braces or a brace in each insert. The pallet 2201 may be preferably held together by application of an adhesive to adjacent parts, like, for example, hot melt adhesive.

Figure 4:
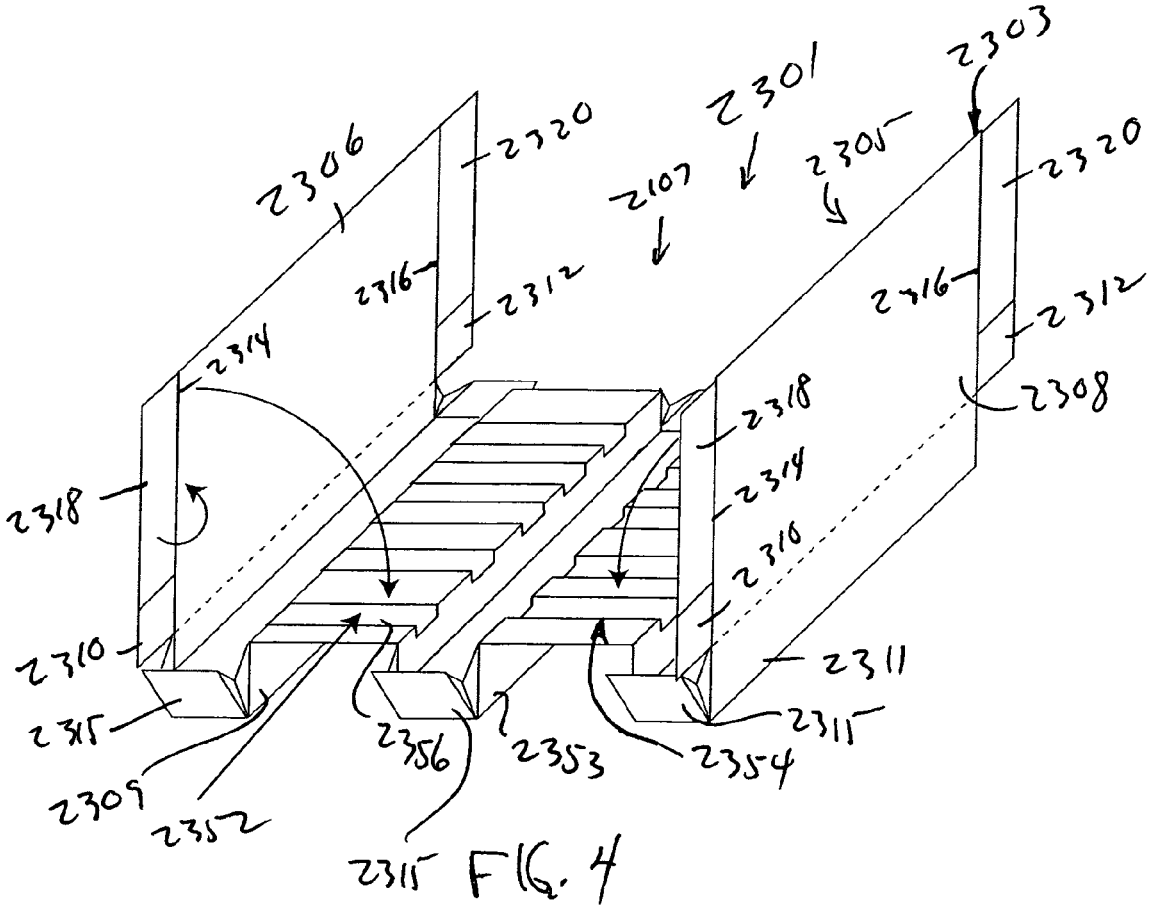
FIG. 4 shows another embodiment of a pallet according to the present invention.

FIG. 4 shows an embodiment of a pallet 2301 like that shown in FIGS. 1 and 2 without inserts or bracing. The platform 2305 includes a left panel 2306 and a right panel 2308 defined by portions of sheet 2303. Each of the left panel 2306 and the right panel 2308 include a front end tab 2310 and a rear end tab 2312 attached respectively to front and rear edges (2314, 2316) of the left panel 2306 and the right panel 2308. Similarly, each of the left panel 2306 and the right panel 2308 include a front under tab 2318 and a rear under tab 2320 attached respectively to front and rear edges 2314, 2316 of the left panel 2306 and the right panel 2308.

The pallet 2301 includes left, right and middle beams 2309, 2311 and 2353, which form a stable base for supporting the pallet. As will be shown below in more detail, the number of beams may be one or more beams.

The platform 2305, which forms a product receiving surface 2107 when panels 2306, 2308 are in a horizontal configuration overlie left and right sections 2352, 2354, which are situated between and provide a span between left and middle beams 2309, 2353, and middle and right beams 2353, 2311, respectively. Each of the left and right pallet sections 2352, 2354 may include a plurality of optional spaced slots 2356, which are positioned and sized to house optional cross braces (see FIG. 2).

Each of beams 2309, 2353, 2311 include a pair of front and rear folding end tabs 2315 for closing each of the beams. When the pallet 2301 is constructed the front and rear folding end tabs 2315 are urged and fixed into a closed position. Various other methods can be used to close the beam, for example, with a separate end cap (not shown).

Optional cross braces (not shown) may be set into position in the slots 2356. The left panel 2306 and a right panel 2308 are lowered onto the cross braces and sections 2352, 2354. The front end tabs 2310 and rear end tabs 2312 are affixed to the tabs 2315 by any suitable means, for example, an adhesive. The front under tab 2318 and a rear under tab 2320 are folded under the sections 2352, 2354 to retain the left panel 2306 and the right panel 2308 in a horizontal position effectively completing the construction of the pallet 2301.

Figure 5:
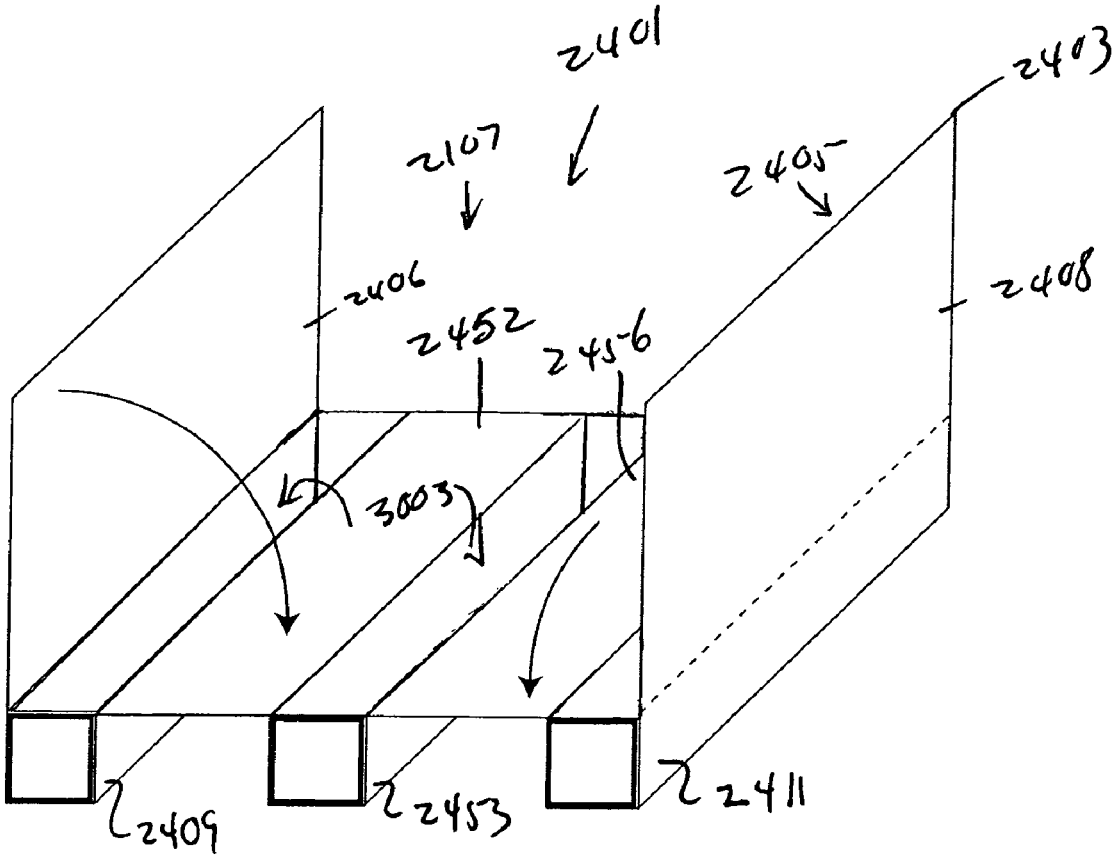
FIG. 5 shows yet another embodiment of a pallet according to the present invention.

FIG. 5 shows an embodiment of a pallet 2401 like that shown in FIG. 3 without inserts or bracing. FIG. 5 shows a pallet 2401 of a unique construction including a continuous, single material sheet 2403 forming a supporting platform generally shown at 2405. Preferably, the material from which the sheet 2403 is made is corrugated paperboard or cardboard as above, but any suitable material may be used.

The present invention may relate to a pallet 2401, which may be assembled at any time or a pre-assembled pallet and more specifically assembled from a single sheet of material. A key feature of the present invention includes the ability to provide one or more pallets 2401 in a flat, pre-assembled condition, which when needed, is easily erected into a supporting state for use as will be explained more fully hereinafter.

The platform 2405 includes a left panel 2406 and a right panel 2408 defined by portions of the sheet 2403. The left panel 2406 and right panel 2408 form rectangular portions of the platform.

The pallet 2401 includes left, right and middle beams 2409, 2411 and 2453. Each of the beams 2409, 2411, and 2453 define a roughly rectangular interior space 3003.

The platform 2405, which forms a product receiving surface 2107 when panels 2406, 2408 are in a generally horizontal configuration overlie left and right sections 2452, 2454, which are situated between and provide a span between left and middle beams 2409, 2453, and middle and right beams 2453, 2411, respectively. Each of the left and right pallet sections 2452, 2454 are flat planar sections. The embodiment of the pallet 2401 shown in FIG. 5 is constructed similar to that shown above with the exception of lacking cross braces or inserts. The pallet 2401 may be preferably held together by application of an adhesive to adjacent parts, like, for example, hot melt adhesive.

Figure 6:
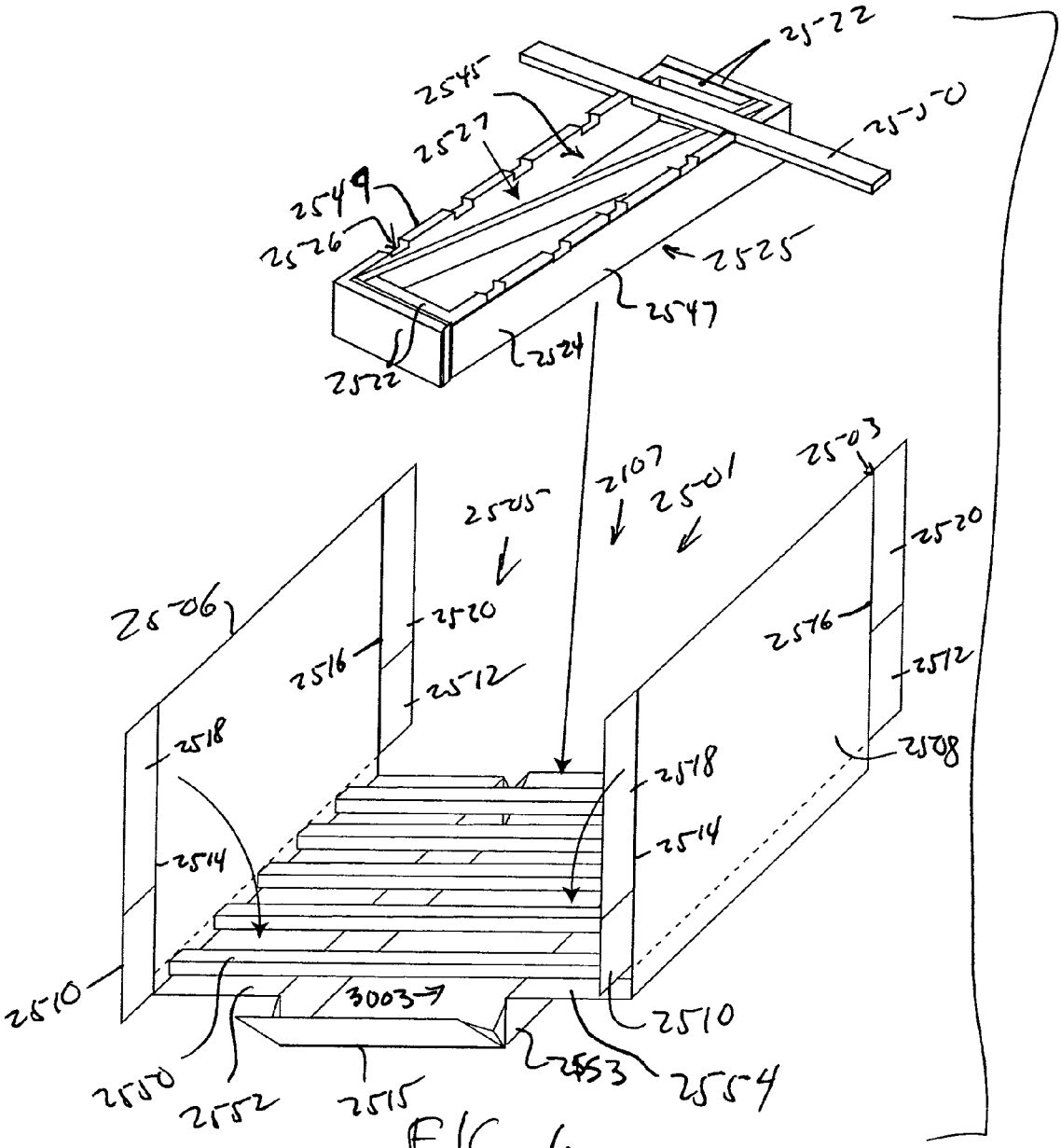
FIG. 6 shows yet another embodiment of a pallet and insert according to the present invention.

FIG. 6 shows another embodiment of a pallet and an insert, according to embodiments of the present invention, and illustrated generally by reference to numbers 2501 and 2525, respectively. Generally, the illustrated embodiment of the pallet 2501 may be of a unique construction including a continuous, single material sheet 2503 forming a supporting platform generally shown at 2505. Preferably, the material from which the sheet 2503 is made is corrugated paperboard or cardboard. However, any suitable material may be used, such as, for example, plastic or combinations of plastic and paper material or other composite materials. Also, the material may include wood, fiberglass, laminated materials, metal, or extruded recycled materials, for example. The present invention may relate to a pallet, which may be assembled at any time or a pre-assembled pallet and more specifically assembled from a sheet-like material. A key feature of the present invention includes the ability to provide one or more pallets 2501 in a flat, pre-assembled condition, which when needed, is easily erected into a supporting state for use as will be explained more fully hereinafter.

Furthermore, the insert 2525 may be considered optional, depending at least in part on the material used to construct the pallet 2501, and also on the intended use of the pallet. For example, if the pallet 2501 is made of a metal material, the inserts 2525 may not be needed for structural reinforcement. In addition, if the pallet 2501 is used to support very lightweight materials, the inserts 2525 may not be needed for structural reinforcement.

The platform 2505, which forms a product receiving surface 2107 when panels 2506, 2508 are in a horizontal configuration, includes a left panel 2506 and a right panel 2508 defined by portions of the sheet 2503. Each of the left panel 2506 and the right panel 2508 include a front end tab 2510 and a rear end tab 2512 attached respectively to front and rear edges 2514, 2516 of the left panel 2506 and the right panel 2508. Similarly, each of the left panel 2506 and the right panel 2508 include a front under tab 2518 and a rear under tab 2520 attached respectively to front and rear edges 2514, 2516 of the left panel 2506 and the right panel 2508.

The pallet 2501 includes a single central beam 2153. The beam 2153 define a roughly rectangular interior space 3003 sized and shaped to receive an insert 2525. The number of beams may be one or more beams.

The insert 2525 includes an interior space 2545 in which a brace 2527 may be inserted. Each insert 2525 includes a first insert member 2547 and a second insert member 2549. Each insert member 2547, 2549 includes two short sides 2522 at opposite ends thereof and a long side 2524 disposed between the short sides. The insert members 2547, 2549 are arranged to form a rectangle with the interior space 2545 defined within for receiving the brace 2527.

The brace 2527 is preferably rigid and may be made of any supportive material, such as, for example, wood, metal, plastic, cardboard, fiberboard, composites, and so on, capable of supporting a load placed on the pallet 2501. The long sides 2524 of the insert members 2547, 2549 include a dentate upper surface 2526 for receiving one or more cross member 2550 for supporting the platform 2505.

The platform 2505, which forms a product receiving surface when in a horizontal configuration overlie left and right sections 2552, 2554, which are situated outboard of the central beam 2553. Each of the left and right pallet sections 2552, 2554 provide support for cross braces 2550 disposed thereon and ultimately platform 2505. Beam 2553 includes a front and rear folding end tab 2515 for closing the beam.

When the pallet 2501 is constructed an insert 2525 is positioned within beam 2553. The front and rear folding end tab 2515 is urged into a closed position. Various other methods can be used to seal the insert 2525 within the beam 2553, for example with a separate end cap (not shown).

Cross braces 2550 are set into position on and spanning sections 2552, 2554. The left panel 2506 and a right panel 2508 are lowered onto the cross braces and sections 2552, 2554. The front end tab 2510 and rear end tab 2512 are folded under affixed sections 2552, 2554 by any suitable means, for example, an adhesive. The front under tab 2518 and a rear under tab 2520 are folded over and fixed to tab 2515 completing the construction of the pallet 2501.

While the present inventions and what is considered presently to be the best modes thereof have been described in a manner that establishes possession thereof by the inventors and that enables those of ordinary skill in the art to make and use the inventions, it will be understood and appreciated that there are many equivalents to the exemplary embodiments disclosed herein and that myriad modifications and variations may be made thereto without departing from the scope and spirit of the inventions, which are to be limited not by the exemplary embodiments but by the appended claims.

I claim:

1. A platform on which product may be generally stably supported thereon, said supporting platform comprising:

a single, continuous sheet of formable material;

said material including a left panel end adjacent to which a left panel is provided and a right panel end adjacent to which a right panel is provided, said left panel and said right panel movable to a generally horizontal position to provide a product receiving surface on which the product is receivable;

said material formed to provide a left beam, a middle beam, and a right beam positioned under said product receiving surface, each of said left beam, said middle beam, and said right beam including a beam interior surface sized and shaped to receive an insert that is sized and shaped to be received within said beam interior surface;

each of said inserts including a first insert member and a second insert member, each of said first insert member and said second insert member including opposing short sides and a long side disposed thereinbetween and connecting each of the opposing short sides to form one of said first insert member or said second insert member each of said first insert member and said second insert member is sized and shaped so that said first insert member and said second insert member can be joined to form one of each of said inserts having an insert interior space in which a brace is positionable;

whereby with insertion of said each of said inserts into each of said beam interior surfaces formed within each of said left beam, said middle beam, and said right beam and movement of said left panel and said right panel to said generally horizontal position said product receiving surface is formed on which the product is receivable and supportable.

2. A platform on which product may be generally stably supported thereon, said supporting platform comprising:

a single, continuous sheet of formable material;

said material including a left panel end adjacent to which a left panel is provided and a right panel end adjacent to which a right panel is provided, said left panel and said right panel movable to a generally horizontal position to provide a product receiving surface on which the product is receivable;

said material formed to provide under said product receiving surface a left beam, a middle beam, and a right beam and a left section extending between said left beam and said middle beam and a right section between said middle beam and said right beam;

said left section and said right section each including a plurality of spaced slots in which cross braces are positionable to further support said product receiving surface;

whereby, with insertion of said cross braces into each of said plurality of spaced slots and movement of said left panel and said right panel to said generally horizontal position, said product receiving surface is formed on which the product is receivable and supportable.

3. A pallet for receipt and general stable support of product thereon, said pallet comprising:

a single, continuous sheet of formable material;

said material including a left panel end adjacent to which a left panel is provided and a right panel end adjacent to which a right panel is provided, said left panel and said right panel movable to a generally horizontal position to provide a product receiving surface on which the product is receivable;

said material formed to provide under said product receiving surface a left beam, a middle beam, and a right beam and a left section extending between said left beam and said middle beam and a right section between said middle beam and said right beam;

each of said left beam, said middle beam, and said right beam including a beam interior surface sized and shaped to receive an insert that is sized and shaped to be received within said beam interior surface;

each of said inserts including opposing short sides and opposing long sides, said opposing long sides including dentate upper surfaces;

said left section and said right section each including a plurality of spaced slots;

cross braces sized and shaped to be received within said dentate upper surfaces and said plurality of spaced slots and under said product receiving surface to further support said product receiving surface;

whereby with insertion of said cross braces into each of said dentate upper surfaces and said plurality spaced slots and movement of said left panel and said right panel to said generally horizontal position said product receiving surface is formed on which the product is receivable and supportable.

* * * * *